United States Patent [19]

Lahndorff et al.

[11] Patent Number: 4,802,254

[45] Date of Patent: Feb. 7, 1989

[54] ANTI-CORD SWALLOWING SYSTEM AND METHOD FOR A FLOOR CLEANER

[75] Inventors: Kendell S. Lahndorff, Harrodsburg; Wilbur C. Bewley, Jr., Lexington, both of Ky.

[73] Assignee: Whirlpool Corporation, Benton Harbor, Mich.

[21] Appl. No.: 188,845

[22] Filed: May 2, 1988

[51] Int. Cl.[4] ..... A47L 9/00

[52] U.S. Cl. ..... 15/41 R; 15/48; 15/179; 15/339; 15/378

[58] Field of Search ..... 15/179, 378, 339, 41 R, 15/48

[56] References Cited

U.S. PATENT DOCUMENTS

| | | | |
|---|---|---|---|
| 1,483,976 | 2/1924 | Hoover | 15/378 X |
| 1,577,696 | 3/1926 | Demaree | 15/378 |
| 2,642,617 | 6/1953 | Lilly | 15/48 X |
| 3,646,629 | 3/1972 | Bienek | 15/48 |

*Primary Examiner*—Chris K. Moore

*Attorney, Agent, or Firm*—Mason, Kolehmainen, Rathburn & Wyss

[57] ABSTRACT

A floor cleaner that includes a rotatable brush having an elongate dowel is provided with an anti-cord swallowing system formed by a plurality of grooves formed about the periphery of the dowel and equally spaced along the length of the dowel. The anti-cord swallowing system also includes a plurality of equally spaced ribs extending from an under surface of a power head housing of the cleaner, each rib being aligned with and extending partially into one of the grooves. The clearance between each rib and its respective groove is such that free rotation of the brush is permitted while the possibility of even small diameter power cords being wrapped around the brush is minimized.

19 Claims, 1 Drawing Sheet

10
12
14
16
18
20
22
24
26
28
30
32
34
36
38
40
42
44
46
48
50
52
53
54
56
58
60
62
64
66
68
A
B
C

ANTI-CORD SWALLOWING SYSTEM AND METHOD FOR A FLOOR CLEANER

BACKGROUND OF THE INVENTION

1. Field Of The Invention

The present invention relates to a new and improved floor cleaner and, more particularly, to an anti-cord swallowing system and method for a floor cleaner, such as a vacuum cleaner, for preventing electrical cords from being wound about a rotatable brush of the floor cleaner.

2. Background Of The Prior Art

Known floor cleaners, such as vacuum cleaners, have a power head or nozzle housing with a rotatable brush, such as a beater brush, therein for engaging a carpet or hard surface to pick up dirt. If the cleaner is moved over a cord, such as the electrical power cord of the cleaner, the cord may be picked up by the rotating brush and get wound thereabout. When a cord is so "swallowed", damage to the mechanical components of the cleaner, as well as to the cord itself, may result. To prevent a cord from being swallowed in one known cleaner, two anti-cord swallowing bars are positooned so as to run under the cleaner's rotatable brush. Although these bars are effective in preventing cords from wrapping around the brush, they limit the extent to which the beater brush can engage the carpet and thus limit or reduce the effectiveness of the cleaner in picking up dirt and debris.

SUMMARY OF THE INVENTION

It is therefore an object of the present invention to provide a new and improved anti-cord swallowing system and method for a floor cleaner, such as a vacuum cleaner, that does not adversely affect the cleaning efficiency of the cleaner.

It is another object of the invention to provide a new and improved anti-cord swallowing system and method for a floor cleaner that prevents cords and the like from being wound around a rotatable brush disposed in the power head housing of the cleaner.

The anti-cord swallowing system and method for a floor cleaner in accordance with the present invention includes a rotatable brush having a dowel with a plurality of grooves formed about the periphery thereof, the grooves being equally spaced along the length of the dowel, and a plurality of equally spaced ribs extending from an inner surface of the power head housing. Each rib is aligned with a groove so as to extend partially into the groove. The clearance between each rib and respective groove is small, on the order of 0.5 millimeter to minimize the possibility of even small diameter cords being wrapped around the rotating brush.

These and other objects, advantages and novel features of the present invention, as well as details of an illustrative embodiment thereof, will be more fully understood from the following description and the drawing.

DETAILED DESCRIPTION OF THE INVENTION

Figures 1, 2, 3:
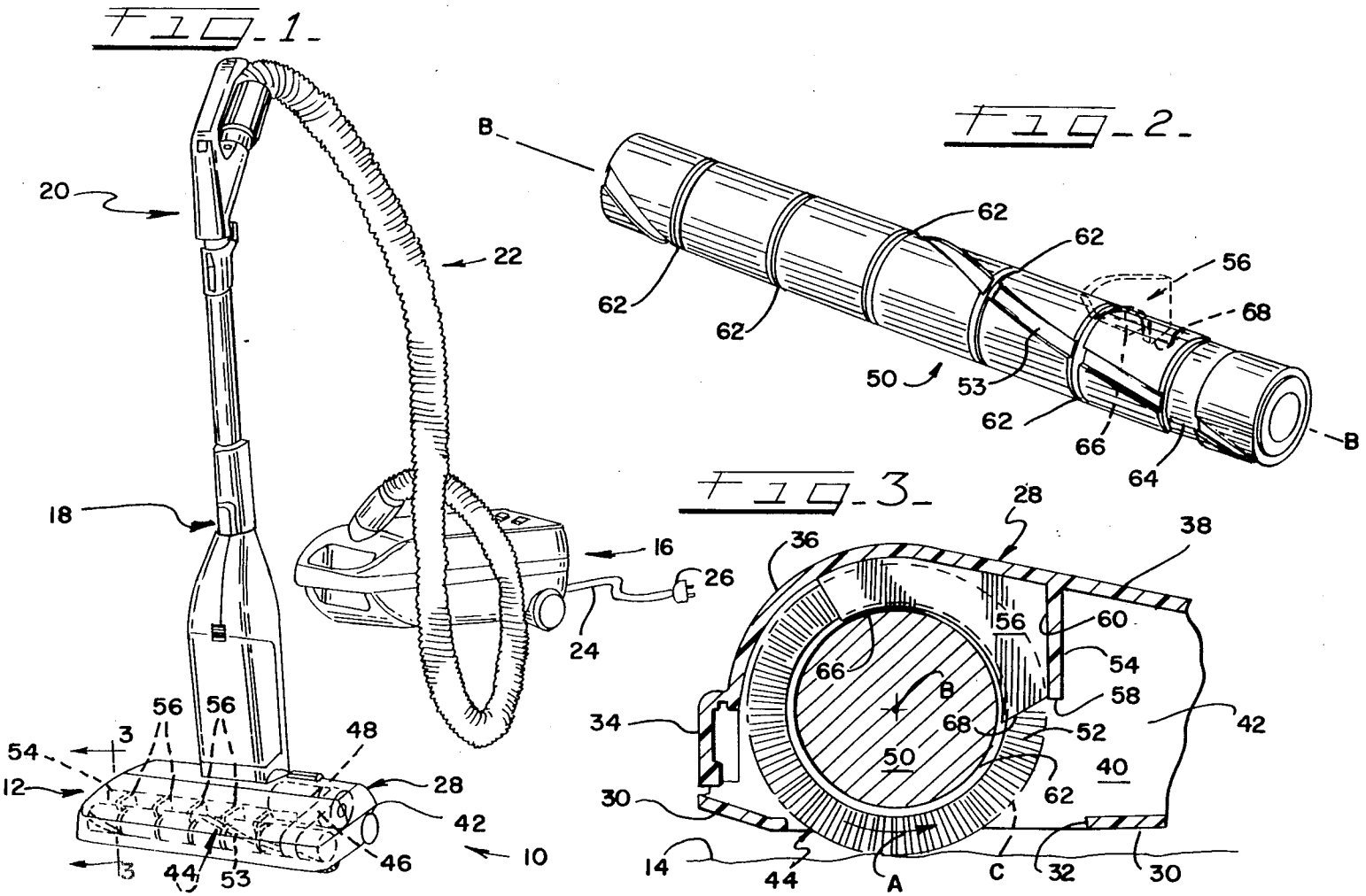
FIG. 1 is a perspective elevational view of a floor cleaner having an anti-cord swallowing system and method constructed in accordance with the principles of the present invention.
FIG. 2 is an enlarged perspective elevational view of a rotatable brush dowel of the cleaner of FIG. 1 with one of a plurality of anti-cord swallowing ribs being shown in phantom.
FIG. 3 is an enlarged, fragmentary cross-sectional view of the cleaner of FIG. 1 taken substantially along lines 3—3 of FIG. 1.

A floor cleaner 10 (FIG. 1) having an anti-cord swallowing system and method constructed in accordance with the principles of the present invention includes a power head 12 adapted to move over a floor or carpet and a remotely disposed canister 16 that is mechanically, electrically and pneumatically interconnected to the power head 12 by a wand assembly 18, a wand handle 20 and a flexible hose assembly 22. Although depicted as a canister vacuum cleaner 10, the principles of the present invention are equally applicable to other floor cleaners having rotatable brushes, for example, upright vacuum cleaners and electric brooms. The power head 12 includes a housing 28 preferably formed of a molded plastic material and having a bottom wall 30 with a generally rectangular opening 32 therein to allow dirt and debris to be picked up from the surface being cleaned. The housing 28 includes a front wall 34 having a curved upper portion 36 joining an integral top wall 38 with a downwardly extending wall 54 partially separating the housing 28 into a forward compartment 41 and a rear compartment 42. A rotatable beater brush 44 is mounted for rotation in a counter-clockwise direction in the forward compartment 41 of the housing 28 such that a portion of the periphery of the beater brush 44 extends through the opening 32. The beater brush 44 is driven by an endless belt 46 powered by an electric motor 48 mounted in a rearward portion of the housing 28.

The beater brush 44 includes an elongate, generally cylindrical, rigid central body or dowel 50 supported from sidewalls 40 of the housing 28 to allow rotation thereof. The dowel 50 may be made of wood, plastic or the like with a groove 64 formed therein to seat the drive belt 46. The dowel 50 has flexible bristles 52 extending radially outwardly therefrom to form the brush 44. The bristles 52 and the brush 44 are disposed in an elongate groove 53 (FIG. 2) spirally disposed along the outer surface of the dowel 50. The outer ends or tips of the bristles 52 of the beater brush 44 project downwardly through the opening 32 so that the moving bristles 52 come in direct contact with the surface 14 being cleaned. The particular locations of the belt 46 and of the motor 48 within the housing 28 and of the groove 64 along the dowel 50 are not germane to the principles of the present invention and may be other than those depicted for illustrative purposes only in FIGS. 1 and 2. For example, in a specific embodiment, the belt 46 and the motor 48 and the groove 64 may be located on the opposite sides of the housing 28 and of the dowel 50 from the locations depicted in FIGS. 1 and 2.

When the cleaner 10 is in operation, dirt and other materials resting on the surface 14 are picked-up by the rotating bristles 52 and sucked into a vacuum chamber 42 in communication with the opening 32. To prevent long flexible objects such as the electrical power cord 24 of the cleaner 10 from being picked up and wound about the beater brush 44, the cleaner 10 includes a plurality of anti-cord swallowing ribs 56 extending downwardly from the interior of the housing 28 into grooves 62 formed in the dowel 50.

More specifically, to form the anti-cord swallowing device of the present invention, five grooves 62 each approximately 4.00 millimeters wide and approximately 1.00 millimeter deep are formed about the periphery of the dowel 50 and are equally spaced along the length thereof. Each of the ribs 52 extends downwardly from an inner surface 60 of the housing 28 above a respective groove 62 and is joined to the wall 54. The ribs 56 preferably are formed as integral parts of the top wall 38 of the housing 28 and are made of injection molded plastic. Alternatively, the ribs 56 may be formed separately from the housing 28 and mounted therein. Each rib 56 extends around at least approximately an upper back quarter of the circumference of the outer surface of the beater brush dowel 50 and has an inner surface 66 that is arcuate in shape with the same general curvature as the respective groove 62 into which the rib 56 extends. Each rib 56 further has an edge 68 angled upwardly from the inner surface 66 to the wall 54. The edge 68 is so angled to aid in deflecting and dislodging cords or other objects carried up by the beater brush 44. Each of the ribs 56 extends approximately 0.50 millimeter or one-half way into a respective groove 62. While the ribs 56 do not touch the dowel 50 and, therefore, permit free rotation thereof, the space between the ribs 56 and the dowel 50 is such that cords having even a very small diameter are prevented from wrapping around the beater brush 44.

In operation, if the cleaner 10 is moved over an electric power cord that is initially engaged by the beater brush 44, the ribs 56 dislodge the cord and prevent it from being wound about the rotating beater brush 44. The number of ribs 56 and grooves 62 may vary depending on the length of the beater brush 44 and the dowel 50. The number of ribs 56 and grooves 62 is selected so that the spacing between adjacent ribs 56 and adjacent grooves 62 is such that a flexible cord, such as an electrical power cord, cannot bend sufficiently to fit easily between adjacent ribs 56.

Obviously, many modifications and variations of the present invention are possible in light of the above teachings. Thus, it is to be understood that, within the scope of the appended claims, the invention may be practiced otherwise than as specifically described hereinabove.

What is claimed and is desired to be secured by Letters Patent is:

1. A floor cleaner comprising
a rotatable beater brush having a dowel,
a housing having an upper wall,
an elongate power cord and
means for preventing said cord from wrapping around said beater brush, said preventing means including a plurality of grooves formed about the periphery of said dowel and spaced apart along the length of said dowel and
a plurality of spaced apart ribs each extending from a surface of said housing and about a circumferential portion of said beater brush, each of said ribs extending partially into one of said grooves.

2. A floor cleaner as recited in claim 1 wherein said grooves are equally spaced along the length of said dowel.

3. A floor cleaner as recited in claim 1 wherein each of said grooves is approximately 1.00 millimeter deep.

4. A floor cleaner as recited in claim 3 wherein each of said ribs extends approximately 0.50 millimeter into a respective one of said grooves.

5. A floor cleaner as recited in claim 1 wherein each of said grooves is approximately 4.00 millimeters wide.

6. A floor cleaner as recited in claim 1 wherein each of said ribs has an arcuate inner surface to conform generally to the curvature of said grooves.

7. A floor cleaner as recited in claim 6 wherein each of said ribs has an edge angled upwardly from the inner surface of the rib to said housing to aid in deflecting a cord away from said beater brush.

8. A floor cleaner as recited in claim 1 wherein said plurality of grooves and said plurality of ribs each equal at least five in number.

9. A floor cleaner comprising
a power head housing having an upper portion with a wall downwardly extending therefrom to form a first compartment in said housing,
a beater brush mounted for rotation in said first compartment of said housing, said beater brush having a dowel with a plurality of grooves formed therein, said grooves being spaced along the length of said dowel and
a plurality of ribs each extending downwardly from an inner surface of said upper portion of said housing above a respective groove and being joined to said wall, each of said ribs extending partially into a respective groove to prevent a cord from being wrapped around said beater brush.

10. A floor cleaner as recited in claim 9 wherein said grooves are equally spaced along the length of said dowel.

11. A floor cleaner as recited in claim 9 wherein each of said grooves is approximately 1.00 millimeters deep.

12. A floor cleaner as recited in claim 11 wherein each of said ribs extends approximately 0.50 millimeters into a respective groove.

13. A floor cleaner as recited in claim 9 wherein each of said grooves is approximately 4.00 millimeters wide.

14. A floor cleaner as recited in claim 9 wherein each of said ribs has an arcuate inner surface generally conforming to the curvature of said grooves.

15. A floor cleaner as recited in claim 14 wherein each of said ribs has an edge angled upwardly from said inner surface to said wall to aid in deflecting a cord away from said beater brush.

16. A floor cleaner as recited in claim 9 wherein said ribs and said grooves each equal at least five in number.

17. A method for preventing a power cord of a floor cleaner having an elongate rotatable brush from wrapping around said rotatable brush comprising the steps of
providing a housing around at least a portion of said brush,
providing a plurality of grooves disposed about the circumference of the dowel portion of said brush, said grooves being spaced apart along the length of said dowel portion,
providing a plurality of ribs extending from said housing, each of said ribs being configured and disposed to extend at least partially into one of said grooves to an extent sufficient to minimize the possibility of said power cord wrapping around said brush while not interfering with the rotation of said brush.

18. A method for preventing a power cord of a floor cleaner having an elongate rotatable brush from wrapping around said rotatable brush as recited in claim 17 wherein said grooves are equally spaced apart along the length of said dowel portion.

19. A method for preventing a power cord of a floor cleaner having an elongate rotatable brush from wrapping around said rotatable brush as recited in claim 17 wherein said ribs are configured and disposed to extend approximately one-half way into said grooves.

* * * * *